United States Patent [19]

Fischer et al.

[11] Patent Number: 4,477,066

[45] Date of Patent: Oct. 16, 1984

[54] APPARATUS FOR SEPARATING OVERLAPPED SHEETS OF FOLDED PRODUCTS

[75] Inventors: Rudolf Fischer, Ludwigshafen-Oggersheim; Helmut Puschnerat, Worms, both of Fed. Rep. of Germany

[73] Assignee: Albert-Frankenthal AG, Fed. Rep. of Germany

[21] Appl. No.: 475,577

[22] Filed: Mar. 15, 1983

[30] Foreign Application Priority Data

Apr. 2, 1982 [DE] Fed. Rep. of Germany ..... 3212350

[51] Int. Cl.[3] ..... B65H 39/00

[52] U.S. Cl. ..... 270/52

[58] Field of Search ..... 270/52–54, 270/57–58; 198/644

[56] References Cited

U.S. PATENT DOCUMENTS 3,722,877 3/1973 Wetter ..... 270/57

4,076,231 2/1978 Kutzner et al. ..... 270/54

FOREIGN PATENT DOCUMENTS 1048465 11/1966 United Kingdom ..... 270/54

*Primary Examiner*—E. H. Eickholt

*Attorney, Agent, or Firm*—Jones, Tullar & Cooper

[57] ABSTRACT

The invention has to do with conveying systems for folded products coming from a folder and each made up of sheets which are overlapped so that their unoverlapped edges are sticking out sideways. For pulling the overlapped sheets out sideways and separating them, the apparatus has two gripping means moving along the sides of the system, each gripping means having a gripping gap for taking up said edges. One gripping means is placed at an angle to the direction of conveying for pulling the sheets out to the side. The gripping means are made up of belts or pulleys running at an equal speed and with a gap between them for the edges. One useful effect of the apparatus is that it is not necessary to keep to any fixed spacing between the products in their direction of transport.

18 Claims, 6 Drawing Figures

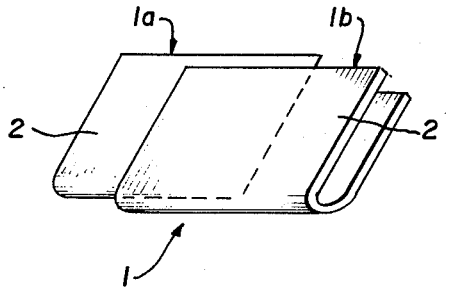
FIG. 1
FIG. 2
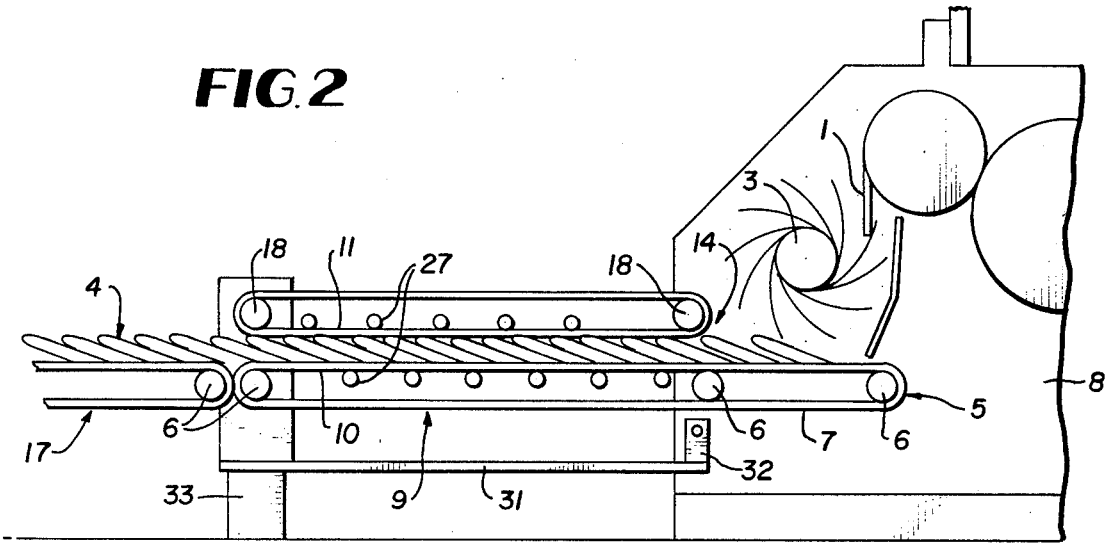
FIG. 3
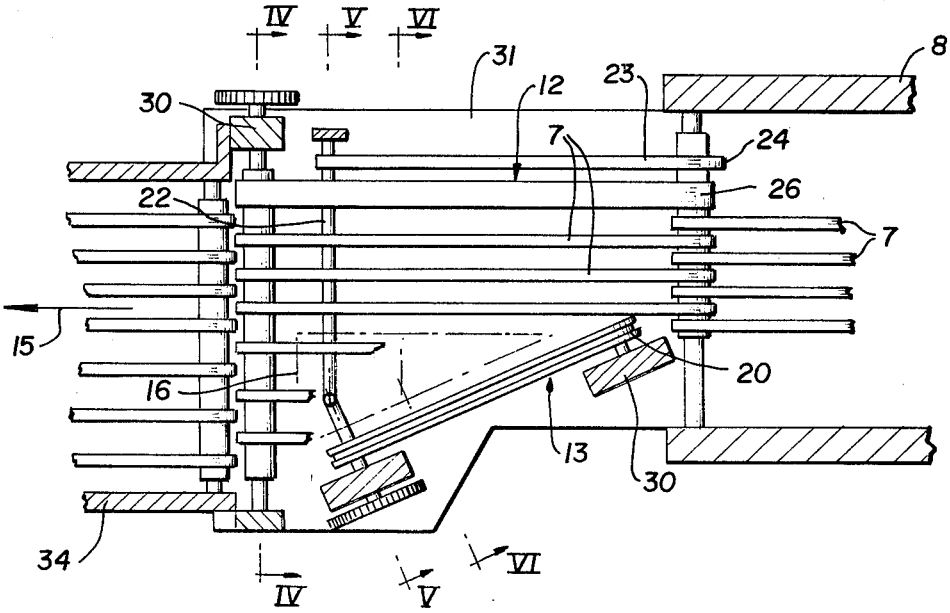

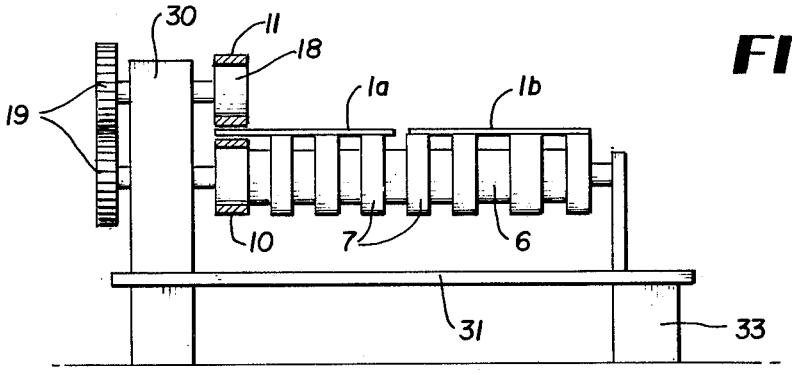
FIG. 4
FIG. 5
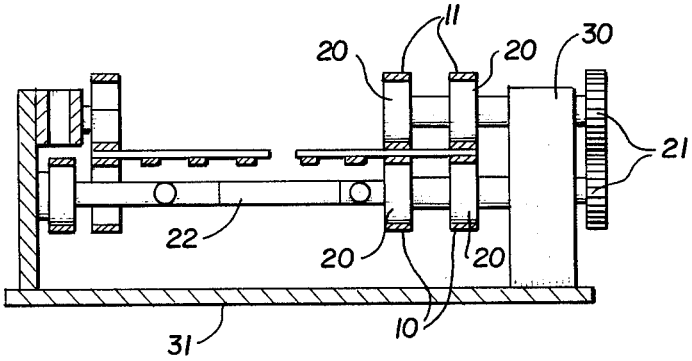
FIG. 6
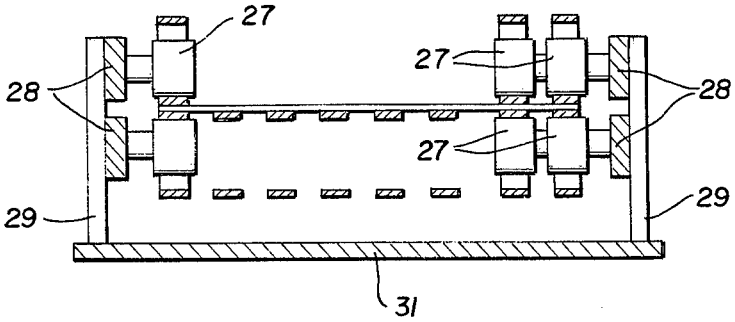

APPARATUS FOR SEPARATING OVERLAPPED SHEETS OF FOLDED PRODUCTS

BACKGROUND OF THE INVENTION

The present invention is with respect to an apparatus for pulling out and separating sheets, that are out of line in the direction of transport, of folded products, and more specially such products being transported in the form of an overlapping train, that is to say with the products overlapped in the direction of transport. Such an apparatus may have holding parts that are placed on the two sides of the path of the products, such holding parts being designed for acting on the free or unoverlapped edges of sheets that are out of line towards the holding parts in question, and are moved along at the same speed as the sheets, at least one of holding parts being moved along with a component of motion across the direction of transport.

DISCUSSION OF THE PRIOR ART

An apparatus designed on these lines is to be seen in the German Pat. No. 2,417,614. Because such apparatus may be used for folding two folded products of the same or different thickness in common and possibly trimming them, it is possible to do without a second folder or a double-width folder. In the known system of the said German Pat. No. 2,417,614 the holding parts are in the form of lines of grippers running along endless belts or the like and having gripper jaws that are placed side by side. Each such gripper is used for gripping a stack of sheets at its free or unoverlapped edges so that the sheets may be moved sideways into the desired position. A shortcoming in this respect is that no adjustment of the spacing between the grippers is possible so that the folded products in the train have to keep to a fixed spacing. To make certain that each gripper only takes up the sheet stack opposite to it, the distance between one folded product and the next one in the train has to be exactly the same as the distance between the grippers and if this is not the case there is a chance of more than one product for example being gripped by a gripper, and then trouble conditions are likely. However it has been seen from experience that the spacing or pitch of the overlapping products on the belt may not always be kept completely regular, as for example because of changes in the amount of friction on the line. On using the apparatus of the said German Pat. No. 2,417,614 it is for this reason necessary to keep a watchful eye on the spacing of the overlapping products and to make certain that they are kept fully in line. The apparatus of the German patent has in fact turned out to be very complex and at the same time likely to get out of order. A further point to keep in mind is that the grippers used for such purposes are not at all sturdy and so likely to get out of order as well and to make frequent upkeep work necessary. More specially there is the shortcoming that the said grippers have to opened and shut by power and this makes much noise and is the cause of much wear. Lastly there is the serious shortcoming that if the sort of product is changed the spacing between the grippers has to be changed to be in keeping therewith. The known apparatus of the German patent may for these reasons be seen not only to be complex and likely to get out of order but furthermore not a very limited range of adjustment.

GENERAL OUTLINE OF THE INVENTION

In view of these shortcomings of the prior art, one purpose of the present invention is that of designing an apparatus of the sort noted, free of such shortcomings, which, when the spacing between the overlapped folded products in the train is not regular or does not keep to the desired spacing, may be used without any trouble.

A still further purpose or object of the invention is that of designing such an apparatus that is sturdy and simple in form and is in need of little upkeep work thereon.

This and further purposes of the invention may be effected in a surprisingly simple way by designing the apparatus in such a way that at least the holding part moved with a component of motion across the direction of transport is in the form of a belt guide or guide track, whose leading end may be adjusted in a sideways direction in relation to the transport direction, said guide track having a gripping gap through which the free or unoverlapped edge strip of the products may be moved, said edge strip being formed by the edges of the sheets that are out of line in a sideways direction and are nearest the gap, said gap being formed by opposite pressing parts such as belts that are turned at a regular speed.

The products running into the gripping gap are guided by the pressing parts and are moved along in a way keeping to the form thereof. Because of the simple sloping form of at least one gripping gap the products running into it are kept in line with each other in the direction of motion and furthermore while being moved forwards are moved sideways, without being turned or twisted, till the sheets, slipped into or overlapped with each other, are completely pulled clear of each other. Because the separate folded products are not gripped separately but are only run into a gripping gap running along to the side of the line of products, there is a useful effect inasfar as the spacing of the products does not have to be completely regular and no makeready work is necessary in this respect so that the plant is simpler in use. The useful effects produced by the present invention are for this reason to be seen in the simple design and the great economies possible therewith.

As part of a useful further development of the invention each gripping gap may be between at least two gripping belts that are run along in contact with each other. This design gives the useful effect of an elastic jaw structure of the gripping gap and a very simple form thereof, while at the same time the gap system is not likely to get out of order. To make certain of strong gripping effect that is equal right along the full length of the gap, between the ends of the belts where they are guided by bend units, such as bend pulleys, it is possible to have pressing rollers. The pressing rollers, placed opposite each other, of the upper and lower belts may be out of line somewhat in order to make certain of a high degree of elasticity along the gripping gap in the direction of transport. This makes it possible for thicker parts of the train of products to be taken care of without any adjustment being necessary or any trouble conditions being caused.

A further development of the invention is to the effect that at least one of the gripping belts or if possible all the gripping belts are in the form of toothed belts running on toothed belt wheels so that there is no slip and the belts are kept completely in step with each other. A further useful effect is to be had if the top and lower gripping belts of each belt guide are joined up with each other by gearing.

Further useful developments and forms of the invention will be seen from the account now to be given of one preferred working example of the invention as based on the figures, and from the claims.

LIST OF DIFFERENT VIEWS OF THE FIGURES

FIG. 1 is a diagrammatic view of a folded product whose sheets are out of line in relation to each other at a right angle to the direction of transport of the product, that is to say sideways.

FIG. 2 is a lengthways diagrammatic section through a separating unit joined up with a folder.

FIG. 3 is a diagrammatic view looking down onto the system of FIG. 2.

FIG. 4 is a section on the line IV—IV of FIG. 3.

FIG. 5 is a section on the line V—V of FIG. 3.

FIG. 6 is a section taken on the line VI—VI of FIG. 3.

DETAILED ACCOUNT OF WORKING EXAMPLE OF THE PRESENT INVENTION

Turning now to FIG. 1 it will be seen that a folded product 1 is made up of two stacks 1*a* and 1*b* of sheets, that are out of line with each oter in a sideways direction so that, by the nature of things, there is a free or unoverlapped edge 2 on each side sticking out from the part of the product where it is two stacks thick. The breadth of the edge 2 is equal to the distance by which the stacks are out of line. At their two side edges 2 the two sheet stacks 1*a* and 1*b* may be gripped and pulled upon for separating them. These stacks may have different or equal numbers of pages. The two stacks may be produced by a single folder, whose working width is only equal to the width of one product plus the distance by which the stacks are offset or out of line with each other.

The design and workings of a folder being generally known, no detailed account thereof will be necessary here. The folded and possibly trimmed folded products are, as may be seen in FIG. 2, delivered using a fan wheel 3 in the form of an overlapping train or stream 4 running on a delivery belt 5, that is made up of two support belts 7 running round support pulleys 6, the belts being spaced out from each other in a sideways direction. The pulleys 6 for the belts may be simply supported in the side walls 8 of the folder. The delivery belt 5 running out from the folder is the first part of a many-part transporter running to a unit for further processing of the products, as for example a parceling unit. At the section 9 of this transporter next to the delivery belt 5 and made up of support belts 7 whose ends are interlaced with the belts of the delivery belt 5, there are holding parts on the two sides of the train 4 of overlapping products, such holding parts being for gripping the free edges 2 of the folded products, moving same along and pulling them out from each other in a sideways direction. There are further belt pulleys for supporting the support belts of the transport section 9 and the further transport sections. Where the sections have their belts interlaced there may be a common belt support pulley or drum on which the support belts 7 of one section and the next are placed in turn one after the other along the length of the common pulley or drum, so that the belts are drivingly joined up with each other.

For forming the holding parts in the present working example of the invention there are track means or belt guides 12 and 13, the upper guide 12 being made up of the upper gripping belt 10 while the lower guide 13 is in the form of the lower gripping belt 11, the two belts forming between them a gripping gap 14 or nip running right the way along their length, such gap taking up the edges 2 of the products in the train 4 of overlapping material. The two belt guides 12 and 13 may have their front ends so placed that they are out of line with the direction of transport as marked by arrow 15. In the present working example, as may best be seen from FIG. 3, the one belt guide 12 is placed parallel to the direction of transport and it is only the other belt guide 13 that has its front end so placed that the guide 13 is at a certain angle to the direction of transport. The lengths of the belt guides 12 and 13 and the size of the angle that they make to the direction of transport has to be such that on running the apparatus with products of the greatest rated width, the products are completely separated from each other and moved clear of each other to the desired degree. In this respect the greatest rated width is the working width of the folder delivering the products less the smallest degree by which the products are out of line with each other. If the product width keeps changing it is best for the amount that the products are out of line with each other to be changed only without sideways adjustment of the belt guides 12 and 13 and they may be permanently fixed in position, even although a system in which such sideways adjustment would be possible would still come within the general idea of the present invention. The products making their way along the transport section 9, the edges 2 of whose sheet stacks 1*a* and 1*b* are to be pulled clear of each other, are taken up into their gripping gaps 14 to be transported and moved along by the driven gripping belts 10 and 11 moving at the same speed, and have their middle parts supported on the support belts 7, that as well are moved along at the same transport speed. It would furthermore be possible to have a stage in the form of a fixed table with slats or the like between the two sides belt guides 12 and 13. Furthermore one might have a three-cornered piece of sheet metal or the like 16 (see FIG. 3) as such a stage for bridging over the space between the belt guides, placed at an angle, and the rest of the system. It would furthermore be possible to have shorter belts 7 at this position. The stacks of sheets moving so that their edges 2 are taken up in the gripping gap 14 of the belt guide 12 running parallel to the direction of transport are only moved in the transport direction and gripped and stopped from moving in the direction normal to the direction of transport, whereas those stacks whose edges are gripped by the gripping gap of the other guide (belt guide 13) are moved along on the transport direction and moved sideways as well. The sideways motion or transport takes place without the products being turned because the belt guide 13 is straight, and in fact the side edges of the product are kept parallel to the direction of transport and the leading edges of the products are kept at a right angle to the said direction of transport. The sideways motion of each stack of sheets as acted upon by the belt guide 13 is responsible for separating the stacks that in the first place were interleaved so that after the transport section 9 there will be two trains of overlapped products. The section 17, coming after the section 9, of the transport system is for this reason made broader than the transport belts 5. At the three-cornered stage it is possible to have a three-cornered piece of sheet metal or shorter support belts, as noted hereinbefore.

The gripping belts 10 and 11 forming the belt guides 12 and 13 are powered by the folder. In the present working example of the invention the driving force is transmitted by the transport or delivery belt 5 which is not to be seen in the present figures. To make this possible the lower gripping belt 10 of the lower belt guide 12, parallel to the direction of transport, is trained over the belt pulleys 6 used for the next support belts 7, the belt pulley that is to the back in the direction of transport being used for the delivery belt 5 as well. The top gripping belt 11 is taken up on the belt pulleys 18 placed over the belt pulleys 6. As may best be seen from FIG. 4, the driving connection with the lower associated gripping belt 10 is by way of spur gear wheels 19 keyed on stub shafts running out to the side. The gripping belts 10 and 11 of the belt guide 13 running out to the side are taken up on belt pulleys 20 placed between the belt pulleys 6 of the transporter section 9, such pulleys, as may be seen from FIG. 5, being coupled together drivingly by way of spur gear wheels 21 placed on driving stub shafts running out to the side. The torque is transmitted to this system by way of a universal joint shaft 22, that is drivingly joined up by way of a small transmission system (placed to the side of the belt guide 12) with the front belt pulley 6 of the delivery belt 5. In the present working example of the invention there is for this purpose a toothed belt 23 trained over belt sprocket 24 on the belt pulley and a belt sprocket 25 whose axis of turning is parallel to the axis of the sprocket 24. By changing the diameter of the belt sprocket 24 and of the belt sprocket 25 the designer may get more or less any desired transmission ratio. These diameters are to be so selected that the gripping belts 10 and 11 of the belt guide 13 placed at the side are driven with a speed that results from the forward speed equal to the speed of the belt guide 12 and the sideways transport speed as two components thereof.

The gripping belts 10 and 11 may be designed in the form of simple belts on the same lines as the support belts 7. To make certain of slip-free running of the gripping belts 10 and 11 they are, in the present working example to be in the form of toothed belts, this being a simple way of making certain that the gripping belts are driven with exactly the same speed. This in turn makes certain that there is no chance of any relative motion between the said gripping belts and the products whose edges are gripped so that same are not damaged. The belt pulleys 18 and 20 are in this case in the form of toothed belt sprockets. The belt pulleys 6 have their own toothed belt sprockets 26 used with the gripping belt 10 of the belt guide 12. The belt guides 12 and 13 may each be formed by single or multiple belt elements placed in line with each other. In the present working example of the invention single belt elements are used for forming the belt guide 12. For forming the belt guide 13 there are double belts. To increase the gripping effect pressing pulleys 27 are between the bend means of the gripping belts 10 and 11, as is be more specially be seen in FIGS. 2 and 6. Such pressing pulleys support the acting run of the belt used therewith so that products move in desired way right the way along the gripping or pinch gap 14. The pressing pulleys 27 used with the lower gripping belt 10 and the top belt 11 are out of line with each other in the direction of transport so that there will still be a certain degree of elasticity at the gripping gap and it will be possible for products of thicker material or with thicker parts in the train of overlapped products to be processed without the driving system being damaged thereby and without adjustment or makeready being necessary, and transport will for this reason be possible without there being any chance of the system getting out of order. The spacing between the gear belt pulleys 18 may be adjustable to take into account different lengths as necessary. In the present working example the one bend belt pulley 18 or both of them may be spring-loaded. For processing trains of overlapped products with different thicknesses it may be best for the upper and/or the pressing pulleys 27 to be placed so that they may be adjusted in position. At the positions where the belts are bent an inlet or outlet gap may be present, although it would furthermore be possible for the bend pulleys or the like to be adjusted in keeping with this. The pressing pulleys 27 are supported on bearings on side plates 28 so that they may be freely turned. The side plates 28 are for their part fixed on supports 29 on the housing.

For supporting the belt pulleys 6 outside the side walls 8 of the folder and the belt pulleys 18 and 20 of the transport section 9 there are pillow bearings 30 that are placed on a support plate 31. The support plate 31 is fixed to the side walls 8 of the folder by way of brackets 32 so that it may be rocked and supported on the floor by way of legs 33. The gear belt wheel 25 joined with the universal joint shaft is simply bearinged in an outwardly running part of the next pillow bearing. The transport section 17 next to the transport section 9 with the side belt guides 12 and 13 has its back belt pulley 6 so near to the front belt pulley 6 of the section 9 that there is a smooth handing over of the products from the one to the other. The side supports 34 of the section may be fixed to the pillow bearings 30 next to them.

Although the account of the invention given has been limited to one preferred form thereof, this is not to be taken as limiting the teachings of the invention in any way and a great number of changes may be made therein. To take an example, it would be possible to have trains of powered conveying wheels or pulleys placed in a number of rows in place of the gripping belts.

We claim:

1. An apparatus for separating folded products being transported one after the other as a train of such products, comprising a transporter made up of at least one section, holding parts placed on two sides of said section, means for driving said holding parts along at the same speed as said products on said section, said holding parts being designed for gripping edges of said products on two sides of each product, said edges being edges of sheets within each said folded product which are overlapped with each other in said product in a sideways direction, at least one of said holding parts having a sideways component of motion for pulling at least one overlapped sheet gripped thereby out of said product while at least one other sheet in said product is gripped by said other holding part and said sheets gripped by the two holding parts are pulled generally clear of each other, at least said holding part with said sideways component of motion having moving means walling in a gripping gap for taking up said edges of said sheets nearest thereto, said moving means having a surface speed in step with motion of said products along said section.

2. The sheet separating apparatus as claimed in claim 1 wherein said moving means are in the form of at least two gripping belts with said gap therebetween.

3. The sheet separating apparatus as claimed in claim 2 comprising bend pulleys at ends of said gripping belts and pressing or loading pulleys between said bend pulleys for pressing said belts onto said product edges.

4. The sheet separating apparatus as claimed in claim 3 wherein pressing pulleys acting on one said belt are out of line with pressing pulleys acting on the other said gripping belt in the length direction of said belts.

5. The sheet separating apparatus as claimed in claim 4 wherein said pressing pulleys are adjustable.

6. The sheet separating apparatus as claimed in claim 3 wherein at least one bend pulley of said bend pulleys is adjustable in position.

7. The sheet separating apparatus as claimed in claim 6 wherein at least one of said bend pulleys is springingly supported.

8. The sheet separating apparatus as claimed in claim 3 wherein at least one of said gripping belts is a gear belt with gear teeth, said apparatus further comprising gear wheels supporting said belts.

9. The sheet separating apparatus as claimed in claim 8 comprising spur gearing driving joining said belts with each other.

10. The sheet separating apparatus as claimed in claim 1 wherein said holding parts are in the form of a track means running in the transport direction along said section and a track means running at an angle thereto, said track means having like pressing means limiting the gripping gaps between them.

11. The sheet separating apparatus as claimed in claim 1 comprising means for driving same from said folder.

12. The sheet separating apparatus as claimed in claim 11 comprising a delivery belt for driving it.

13. The sheet separating apparatus as claimed in claim 10 comprising a universal joint shaft for driving said track means and a transmission joined therewith.

14. The sheet separating apparatus as claimed in claim 13 comprising a delivery belt that is joined with said transmission.

15. The sheet separating apparatus as claimed in claim 14 comprising a pulley supporting said track means next to said delivery belt.

16. The sheet separating apparatus as claimed in claim 1 having a three-cornered stage for supporting said folded products next to said holding part with a sideways motion component.

17. The sheet separating apparatus as claimed in claim 16 wherein said stage is made up of a sheet metal guide.

18. The sheet separating apparatus as claimed in claim 16 having short belts making up said stage.

* * * * *